US006398180B1

(12) United States Patent
Eyring et al.

(10) Patent No.: US 6,398,180 B1
(45) **Date of Patent: *Jun. 4, 2002**

(54) EXTRUDED PLASTIC BULKHEAD DEVICE FOR FORMING CONCRETE PANELS

(75) Inventors: Kurt S. Eyring; Kyozaburo Takagi, both of Centerville, OH (US)

(73) Assignees: Miller-Valentine Construction Inc., Dayton; Fukuvi USA, Inc., Huber Heights, both of OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/418,385

(22) Filed: Oct. 14, 1999

(51) Int. Cl.[7] ..... B28B 7/16
(52) U.S. Cl. ..... 249/177; 249/189; 249/205
(58) Field of Search ..... 249/187.1, 139, 249/205, 177, 35, 39, 188, 189

(56) References Cited

U.S. PATENT DOCUMENTS 4,042,205 A * 8/1977 Herrell ..... 249/189
4,470,574 A * 9/1984 Jackson ..... 249/205
6,182,416 B1 * 2/2001 Brackin ..... 52/745.09
6,279,868 B1 * 8/2001 Eyring et al. ..... 249/177

* cited by examiner

*Primary Examiner*—Nam Nguyen
*Assistant Examiner*—Joseph S Del Sole
(74) *Attorney, Agent, or Firm*—Jacox, Meckstroth & Jenkins

(57) ABSTRACT

Adjacent tilt-up concrete wall panels are poured on a horizontal concrete floor or forming surface and are separated by a bulkhead device including a base member or channel of extruded semi-rigid plastics material and secured by screws to the forming surface. The base channel has upwardly projecting walls with inwardly projecting opposing teeth which releasably engage outwardly projecting teeth on spaced side walls of a generally U-shaped bulkhead member of extruded semi-rigid plastics material. The spaced side walls also have opposing ribs for gripping a bulkhead extension member, and the bulkhead member is also extruded with outwardly and downwardly projecting walls which have tapered lower edge portions engaging the forming surface to form chamfer corners on the concrete panels.

9 Claims, 1 Drawing Sheet

EXTRUDED PLASTIC BULKHEAD DEVICE FOR FORMING CONCRETE PANELS

BACKGROUND OF THE INVENTION

In the construction of commercial and industrial buildings of the type which has concrete wall panels formed by using the tilt-slab method, a concrete building floor is normally poured in place and is then coated with a release agent to form a horizontal forming surface for the wall panels. The forms for producing the concrete wall panels are then placed on the forming surface, and reinforcing steel or rebars are positioned within the forms. When concrete is poured within the forms, the top edges of the forms are used as a guide for a screed which forms the top surface of the wall panels. After the concrete wall panels are cured, they are lifted or tilted to vertical positions to form the outer walls of the building.

The forms include bulkheads which separate and define the adjacent concrete wall panels poured onto the forming surface, and the bulkheads are usually constructed of solid wood boards. When it is desired to form chamfer corners on the outer and/or inner surfaces of the concrete wall panels to avoid chipping of the concrete at the corners of the wall panels and/or for receiving a joint caulking or other gap filling material, triangular strips of wood are commonly glued or attached to edge portions of the wood bulkhead boards. The bulkhead boards and strips are then treated or sprayed with a concrete release agent. However, it is not uncommon for the wood bulkhead boards and attached chamfer forming strips to be destroyed or damaged when the cured concrete wall panels are separated and tilted to vertical positions. As a result, the bulkhead forming boards and chamfer forming strips cannot be reused.

It is known to extrude a chamfer forming strip of a semi-rigid plastics material such as polyvinylchloride (PVC) and with a generally uniform wall thickness. The extruded strip includes a slightly arcuate bottom wall which integrally connects upwardly and inwardly projecting side walls having chamfer forming outer surfaces. The upper edges of the inclined chamfer forming walls engage opposite side surfaces of a bulkhead forming board which is held in a vertical position by fasteners or nails at opposite ends of the board. The chamfer forming extrusion eliminates the need for attaching the triangular chamfer forming wood strips to the edge portions of the wood bulkhead boards.

SUMMARY OF THE INVENTION

The present invention is directed to an improved bulkhead device for separating adjacent concrete wall panels poured onto a concrete floor or other forming surface and which provides the desirable advantages of durability, reusability and economy of construction in addition to providing a high quality joint between the concrete panels. The bulkhead device of the invention may also be cut to desired lengths with conventional cutting tools and minimizes the use of fasteners such and screws and nails, and requires no special coating or concrete release agent on the device.

In accordance with a preferred embodiment of the invention, a bulkhead device includes an elongated base member or channel of extruded semi-rigid plastics material and which is adapted to be secured by screws to a concrete floor or other forming surface. The base channel has upwardly projecting side walls with inwardly projecting and longitudinally extending opposing teeth. The teeth releasably engage outwardly projecting teeth on the lower portion of space side walls of a generally U-shaped bulkhead member of extruded semi-rigid plastics material. The space side walls of the bulkhead member have opposing inner ribs or teeth for gripping a bulkhead extension member or board.

Inclined walls project outwardly and downwardly from the side walls of the bulkhead member and have lower tapered edge portions for engaging the forming surface to form chamfer corners on the concrete panels.

Other features and advantages of the invention will be apparent from the following description, the accompanying drawing and the appended claims.

DESCRIPTION OF THE PREFERRED EMBODIMENT

Figure 1:
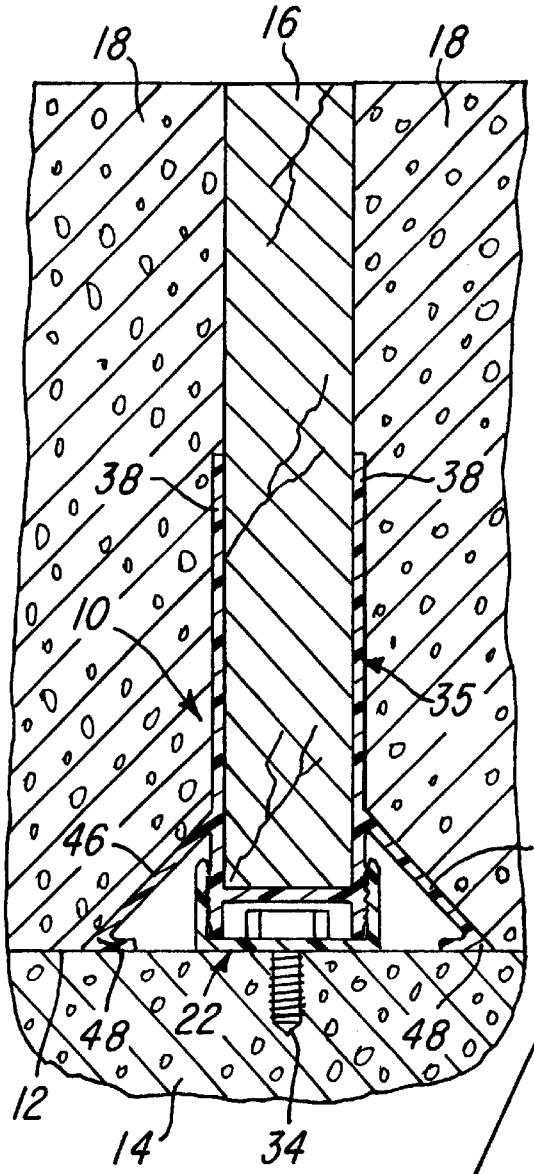
FIG. 1 is an end view of an assembled and installed bulkhead device constructed in accordance with the invention and illustrating its use with a wood bulkhead extension member for forming poured concrete wall panels having chamfered corner surfaces.
Figure 2:
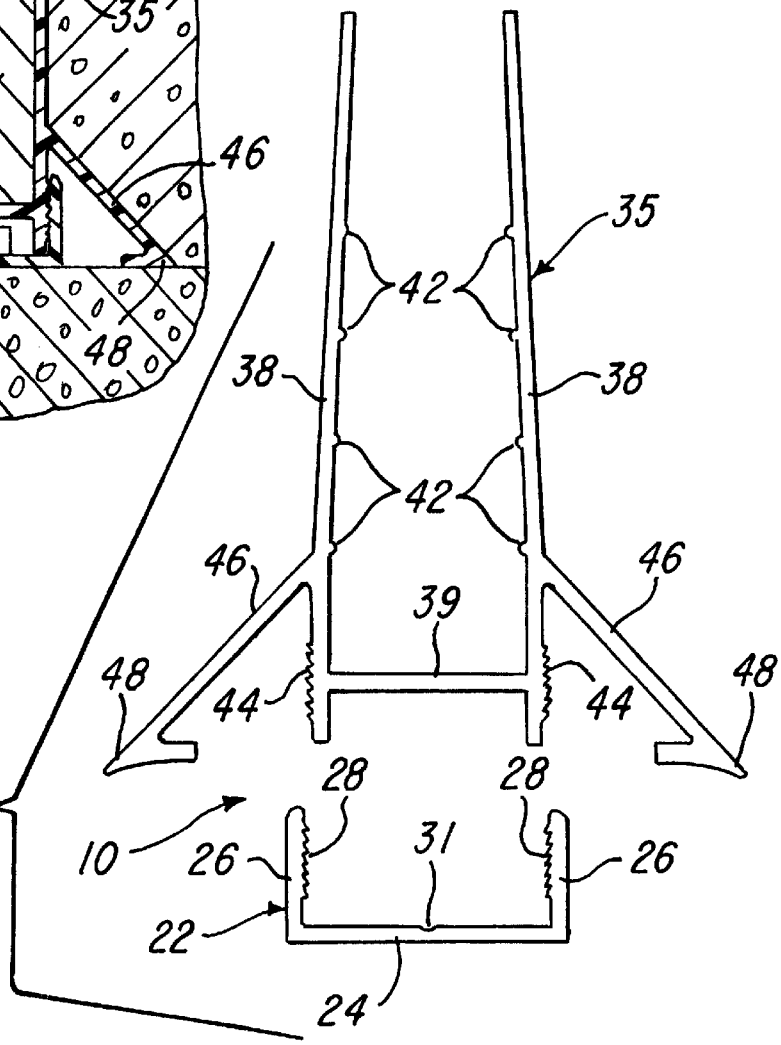
FIG. 2 is a somewhat larger and exploded end view of the bulkhead device constructed in accordance with the invention and shown in FIG. 1.

Referring to FIG. 1, an elongated bulkhead rustication device 10 is constructed in accordance with the invention and is mounted on a forming surface 12 formed by a concrete floor 14 and with the surface 12 sprayed with a concrete release agent. The bulkhead device 10 receives a bulkhead extension member or board 16 and is used to separate adjacent reinforced concrete wall panels 18 which are poured onto the floor or forming surface 12. The top edge surface of the bulkhead extension member or board 16 is used to guide a screed which forms a top flat surface on each wall panel 18. As mentioned above, after each of the concrete wall panels 18 is cured, the horizontal panel is lifted or tilted to a vertical position with the aid of a crane, to form the outer walls of the building.

In accordance with the invention, the bulkhead device 10 includes an elongated base member or channel 22 which is extruded of a semi-rigid plastics material such as polyvinylchloride (PVC). The elongated base member or channel 22 includes a bottom wall 24 which integrally connects parallel spaced vertical side walls 26 having a series of inwardly projecting opposing saw tooth locking ribs or teeth 28. A longitudinally extending depression or groove 31 extends within the top center of the bottom wall 24. The groove 31 provides for conveniently locating a drill bit to form longitudinally spaced holes within the channel 22 and the concrete floor 14 for receiving corresponding threaded fasteners or screws 34 which secure the channel 22 to the forming surface 12. Preferably, the spacing between the walls 26 is about 23 mm.

The bulkhead device 10 also includes a generally U-shaped bulkhead rustication member 35 which is extruded of the same material as the base member 22 and includes longitudinally extending generally vertical side walls 38 integrally connected by a bottom wall 39. The side walls 38 have a series of longitudinally extending and parallel spaced opposing gripping teeth or ribs 42 which are effective to engage the bulkhead extension member or wood board 16, as shown in FIG. 1. The lower portions of the side walls 38 have outer surfaces with outwardly projecting saw tooth locking ribs or teeth 44 which releasably engage the opposing saw tooth locking ribs or teeth 28 on the inner surfaces of the side walls 26 of the base channel 22. The extruded bulkhead member 35 also includes a pair of chamfer forming walls 46 which are integrally extruded and project downwardly and outwardly from the side walls 38 at an angle of about 45°. The inclined walls 46 have lower tapered edge portions 48 which positively engage and seat on the forming surface 12, as shown in FIG. 1.

The bulkhead rustication device 10 is installed by first securing the base member or channel 22 to the forming surface 12 by the longitudinally spaced fasteners or screws 34. A base channel 22 is located on the surface 12 wherever it is desired to have a separation between the poured concrete panels 18. One of the elongated bulkhead members 35 is then pressed downwardly into each base channel 22 until the bottom edge portions 28 of the walls 46 seat on the forming surface 12, and usually the bottom edges of the walls 38 seat on the bottom wall of the base channel 22. The precut bulkhead extension board 16 is then inserted into each bulkhead member 35 until it seats on the bottom wall 39 of the member 35.

The slightly converging walls 38 of the bulkhead member 35 cooperate with the gripping ribs or teeth 42 to form a positive grip of the bulkhead extension board 16. The width of the board 16 is cut according to the desired thickness of the concrete panels 18, and the top edge of the board is used as a guide for the screed which forms the top surface of each concrete panel 18. After the concrete panels 18 are cured, they are successively lifted or tilted to vertical positions, at which time the edge surfaces of each panel separate from each bulkhead device 10 and the corresponding bulkhead extension member or board 16. Each bulkhead member 35 may then be pulled upwardly to release it from its corresponding retaining channel 22 which is then removed by removing the screws or fasteners 34.

From the drawing and the above description, it is apparent that a bulkhead rustication device constructed in accordance with the present invention, provides desirable features and advantages. For example, the extruded semi-rigid plastic device is durable and reusable and forms a high quality joint with precision chamfer corners between adjacent concrete wall panels. The bulkhead member 35 requires no special coating or concrete release agent, and no fasteners are required to retain the bulkhead extension member or board 16 so that the board may be reused many times. In addition, the strength of the base member or channel 22 also minimizes the number of screws or fasteners 34, and the interfitting teeth 28 and 44 cooperate with the slight flexibility of the walls 26 to form a positive but releasable connection or coupling of the member 35 to the member 22 without the use of any separate fasteners. The adjustable interfitting teeth 28 and 44 also assure that the tapered bottom edge portions 48 of the chamfer forming walls 46 engage the forming surface 12, even when the forming surface 12 is somewhat irregular and not perfectly smooth and flat. That is, the edge portions 48 may engage the forming surface 12 before the bottom edges of the walls 38 engage the bottom surface 24 of the base channel retaining channel 22.

It is also within the scope of the invention to install a bulkhead member 35 in an inverted position on the upper portion of the bulkhead extension member or board 16 when it is desired to have clean and uniform chamfer corner surfaces on both the inside and outside edge portions of the concrete wall panels 18.

While the form of device herein described constitutes a preferred embodiment of the invention, it is to be understood that the invention is not limited to this precise form of device, and that changes may be made therein without departing from the scope and spirit of the invention as defined in the appended claims.

What is claimed is:

1. A device for separating adjacent concrete panels poured onto a forming surface, comprising an elongated U-shaped base channel having generally vertical side walls with inwardly projecting and longitudinally extending opposing teeth and adapted to be secured to the forming surface, an elongated generally U-shaped bulkhead member including a lower longitudinally extending portion releasably connected to said base channel, said base channel and said bulkhead member comprising extrusions of substantially rigid plastics material, said bulkhead member having generally parallel spaced longitudinally extending side walls defining a cavity adapted to receive a longitudinally extending bulkhead extension member projecting above said bulkhead member, and said bulkhead member including chamfer forming walls projecting downwardly and outwardly from said side walls and having lower edge portions disposed for engaging the forming surface.

2. A device as defined in claim 1 wherein said lower longitudinally extending portion of said bulkhead member defines a longitudinally extending recess adapted to receive head portions of longitudinally spaced fasteners for securing said base channel to the forming surface.

3. A device as defined in claim 1 wherein said side walls of said bulkhead member have longitudinally extending and parallel spaced opposing gripping ribs adapted for engaging and releasably retaining the bulkhead extension member.

4. A device as defined in claim 1 in combination with a bulkhead extension member comprising an elongated wood board having a lower portion confined between said side walls of said bulkhead member.

5. A device for separating adjacent concrete panels poured onto a forming surface, comprising an elongated base channel having longitudinally extending and generally vertical side walls integrally connected by a base wall adapted to be secured to the forming surface, each of said side walls having a plurality of longitudinally extending and vertically spaced teeth, an elongated bulkhead member including a longitudinally extending lower portion having a plurality of longitudinally extending vertically spaced teeth releasably connected to said teeth on said side walls of said base channel, said base channel and said bulkhead member comprising extrusions of substantially rigid plastics material, said bulkhead member having longitudinally extending and generally parallel spaced side walls defining an upwardly facing open cavity adapted to receive a longitudinally extending bulkhead extension member projecting above said bulkhead member, and said bulkhead member including chamfer forming walls projecting downwardly and laterally outwardly from said side walls of said bulkhead member and having lower edge portions disposed for engaging the forming surface.

6. A device as defined in claim 5 wherein said lower portion of said bulkhead member defines a longitudinally extending and downwardly facing recess adapted to receive head portions of longitudinally spaced fasteners securing said base channel to the forming surface.

7. A device as defined in claim 5 wherein said side walls of said bulkhead member have longitudinally extending and vertically spaced opposing gripping ribs adapted to engage and releasably retain the bulkhead extension member.

8. A device as defined in claim 5 in combination with a bulkhead extension member comprising an elongated wood board having a lower portion confined between said side walls of said bulkhead member.

9. A device as defined in claim 5 wherein said lower edge portions of said chamfer forming walls are tapered and flexible to form a seal with a slightly irregular forming surface.

* * * * *